US005123576A

United States Patent [19]

Lawrence

[11] Patent Number: 5,123,576

[45] Date of Patent: Jun. 23, 1992

[54] PAINT CAN ACCESSORY

[76] Inventor: Jonnay J. Lawrence, 321 NE. 25th St., Pompane Beach, Fla. 33064

[21] Appl. No.: 583,098

[22] Filed: Sep. 17, 1990

[51] Int. Cl.[5] ..... B65D 25/48

[52] U.S. Cl. ..... 222/570; 15/257.06; 220/697

[58] Field of Search ..... 222/570; 220/90; 15/257 R, 257.05, 257.06; 206/362; 401/118; 248/110

[56] References Cited

U.S. PATENT DOCUMENTS

| | | | |
|---|---|---|---|
| 2,151,895 | 3/1939 | Carlson | 220/90 |
| 2,661,858 | 12/1953 | Howell | 15/257.06 |
| 2,698,450 | 1/1955 | Mack | 15/121.1 |
| 3,087,190 | 4/1963 | Werner | 15/257.06 |
| 3,837,034 | 9/1974 | Leffert et al. | 15/257.06 |
| 3,899,107 | 8/1975 | Gaal | 220/90 |
| 3,901.256 | 8/1975 | Habostad | 134/138 |
| 4,145,789 | 3/1979 | Morgan, Sr. | 220/90 |
| 4,203,537 | 5/1980 | Mc Alister | 222/570 |
| 4,240,568 | 12/1980 | Pool | 222/570 |
| 4,266,746 | 5/1981 | Klaiber | 220/90 |
| 4,299,340 | 11/1981 | Hrytzak | 220/90 |
| 4,832,293 | 5/1989 | Gizzi | 248/110 |
| 4,890,353 | 1/1990 | Shannon et al. | 15/257 R |
| 4,907,714 | 3/1990 | Gatz | 222/570 |

*Primary Examiner*—Kevin P. Shaver
*Assistant Examiner*—Philippe Derakshani
*Attorney, Agent, or Firm*—Alvin S. Blum

[57] ABSTRACT

A tray with vertical sides has a large opening defined by a downwardly directed, tapered cylinder that seals into the top of a paint can. A support on the tray holds a paint brush on edge. A support is also provided for a paint roller. The supports are arranged so that paint drains into the can and the handles are unsoiled. Either the brush or the roller may be used while the other remains supported in the tray out of the way. A device across the opening allows removal of excess paint. The tray may be used to distribute paint on the roller. The opening provides access to the paint, and the accessory locks in place so that open can with both roller and brush in place may be carried about as a unit. The accessory includes a pouring spout.

4 Claims, 1 Drawing Sheet

PAINT CAN ACCESSORY

BACKGROUND OF THE INVENTION

This invention relates to painting accessories and more particularly to an accessory that engages the top edge of a paint can, holds both a brush and a roller, and provides am edge for scraping the brush and a panel for removing excess paint from the roller.

Paint brush holders and scrapers for paint cans of the prior art are exemplified by U.S. Pat. No. 4,832,293 issued May 23, 1989 to Gizzi. Paint roller holders and trays for paint cans of the prior art are exemplified by U.S. Pat. No. 2,698,450 issued Jan. 4, 1955 to Mack. The devices of the prior art are useful where either a paint brush is used for detail or a wide paint roller is being used for broad surfaces. However, there are certain painting tasks that are best accomplished by using together a small (2½ inches or less) brush and a small (4 inches or less) roller. These tasks include painting doors and the upper edge of walls where care must be exercised to avoid getting paint on the ceiling. The small roller can cover the larger surfaces while the brush covers the finer details. However, it is so awkward to carry along both a wet brush and roller and paint can that the painter usually compromises by using only one.

Having an accessory that fits onto a paint can that permits effective use of both brush and roller with means for holding one while the other is in use and holding both while carrying the can from place to place enables the painter to take advantage of the desirable features of both applicators which is not possible with the prior art. The painter can then work faster with higher quality results.

SUMMARY OF THE INVENTION

It is accordingly an object of the invention to provide an accessory that snaps securely into the top edge of a paint can to hold both a paint roller and a paint brush is such fashion that the can of paint may be carried about with both and used with either one while the other rests securely in the accessory. It is another object to provide such an accessory that also provides means for removing excess paint from the brush or roller. It is yet another object to provide the accessory with a pouring spout that prevents poured paint from entering the melting groove of the can.

The accessory of the invention has a short, tapered, vertical cylinder with a locking ring to fit sealingly into the can. The upper end of the cylinder is connected to a horizontal tray with vertical edges. The tray provides a means for distributing the paint of the roller. The tray has a large opening at the joint to the cylinder through which the roller and brush may be dipped into the paint. A scraper is positioned across the opening for removing excess paint from brush or roller. Elements are arranged so that excess paint drains back into the can.

These and other objects, advantages and features of the invention will become more apparent when the detailed description is studied in conjunction with the drawings.

DETAILED DESCRIPTION OF THE PREFERRED EMBODIMENT

Figure 1:
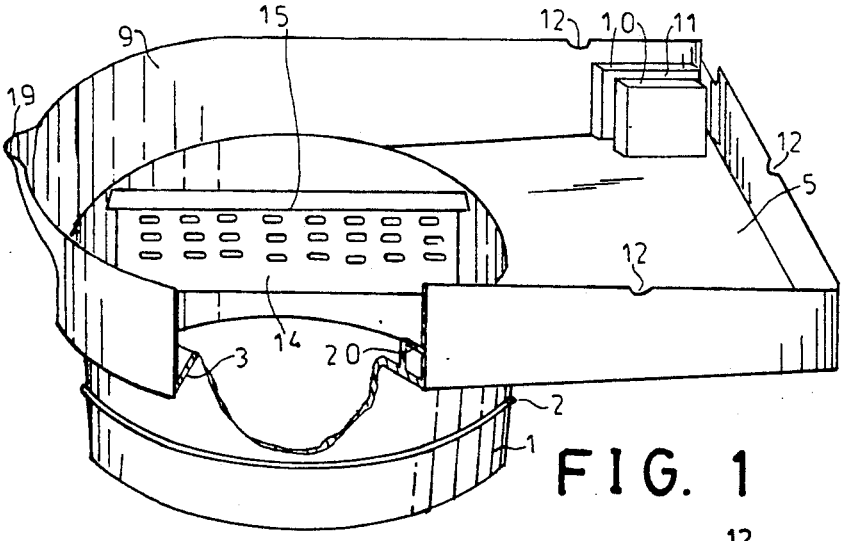
FIG. 1 is a perspective view of the accessory with a portion cut away.

Referring now to the drawings in which the like reference characters indicate corresponding elements throughout the several views, attention is first directed to FIG. 1 which shows an accessory constructed in accordance with the teachings of the instant invention and having a tapered cylindrical base portion 1 that is constructed to fit snugly within the rim of the standard one gallon paint can. The entire accessory is molded in one piece of a polyolefin thermoplastic having sufficient resiliency to adapt to minor variations in can structure. The surface of the plastic is smooth and has non-stick properties for ease of cleaning. An annular ridge 2 on the exterior surface of base 1 snaps beneath the can rim to hold the accessory firmly in position on the can.

Figure 3:
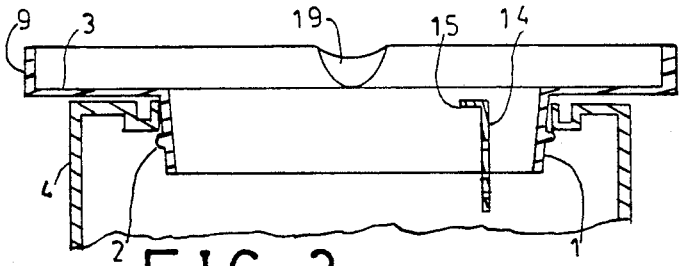
FIG. 3 is a sectional view taken through 3—3 of FIG. 2.

Connected to the upper end of the cylindrical base portion 1 is a horizontal plate 3 which limits penetration within the paint can 4 as best seen in FIG. 3. The horizontal plate 3 forms a tray 5 that may be used to distribute paint on the paint roller 6. A vertical wall 9 borders the entire edge of the horizontal plate 3 to retain paint within the accessory.

Figure 4:
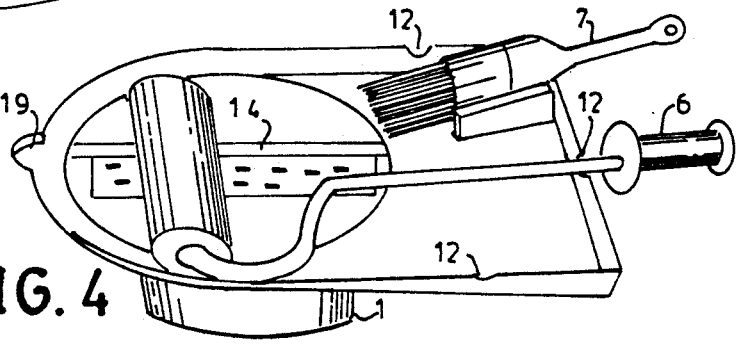
FIG. 4 is a perspective view of the accessory with both brush and roller stored thereon.

A pair of parallel vertical projections 10 extend upward from the horizontal plate 3 to define an open top trough 11 with parallel side walls to conveniently hold, on edge, a paintbrush 7 as best seen in FIG. 4 where both brush and roller are held in non-use position as when carrying the paint to another location. Notches 12 in wall 9 engage the handle of the tool to help hold the tool in place.

Figure 2:
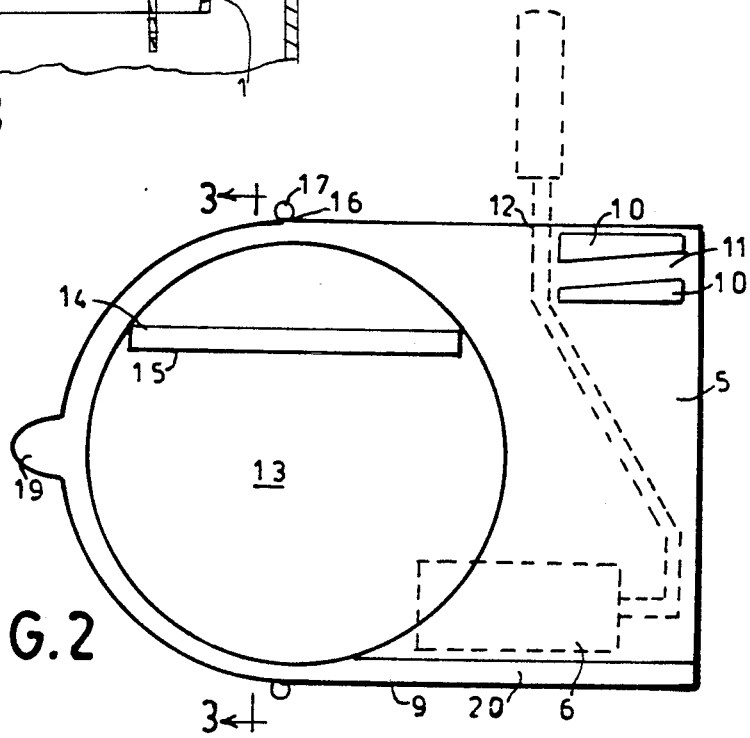
FIG. 2 is a top view of the accessory with roller stored to facilitate use of brush.

When the brush 7 is in use, roller 6 is stored out of the way on the tray as shown in FIG. 2 so that the opening 13 to the paint is unobstructed.

A combined scraping plate and roller screen 14 is attached at its ends to the inner surface of the base 1. It provides a flat edge 15 against which to wipe excess paint off the bristles to ensure uniform loading. It also serves to roll excess paint off the roller before using the tray 5 for uniformly distributing paint on the roller. Plate 3 slopes downward to opening 13 for drainage.

The trough 11 holds brush 7 out of the operating path of the roller by simply resting the brush on its side in the trough. It requires no fitting or adjustment or special modification of the brush. The arrangement makes it so easy to change from one tool to the other that one can use both tools simultaneously in those painting situations where the advantages of both tools improves the speed and quality of the operation.

The wall 9 is resilient enough and located at points 16 of FIG. 2 such that a bail 17 on the can may be raised while the accessory is in place. At one end the wall 9 bends to form pouring spout 19. Ledge 20 steadies the roller and prevents it from touching the top of wall 9.

The accessory has the additional advantage that its use prevents paint from inadvertently contaminating the sealing rim of the paint can while pouring or painting.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An accessory for combined use of a brush and roller for removably attaching to a container having a circular top opening rim, said accessory comprising:

(A) a continuous annular tray extending over said rim, including, 1) a plate having an inner edge defining an opening therethrough, an outer edge, and top and bottom surfaces, said plate having an area for distributing liquid on a roller, 2) an upstanding wall connected to said outer edge and completely surrounding said tray, 3) a plurality of notches in said upstanding wall for receiving a handle of a painting tool while said tool rests upon said top surface, 4) a trough means for receiving a brush on edge, said trough means having an open top and ends and arranged upstanding from said top surface whereby the bristles of said brush rest horizontally upon said top surface; and (B) a cylindrical base portion having an upper edge, a lower edge and a tapering cylindrical wall with an inner surface and an outer surface, said cylindrical wall having a greater diameter at said upper edge, said upper edge continuously connected to said inner edge of said annular tray and said lower edge having a diameter less than the inside diameter of said rim of said container; and (C) an annular ridge means for engaging the underside of said rim of said container, said annular ridge means connected to said outer surface of said cylindrical wall; and (D) a liquid wiping member disposed within said base portion said wiping member having two ends, said ends connected to said inner surface of said cylindrical wall.

2. The accessory according to claim 1 further comprising a pouring spout formed in said upstanding wall of said tray.

3. The accessory according to claim 1 in which said liquid wiping member includes a perforated vertical plate for wiping said roller and a horizontal scraping element connected to said perforated plate at an upper edge thereof for providing for wiping excess liquid from a brush, said upper edge arranged for supporting said roller at rest.

4. The accessory according to claim 1 in which said top surface of said plate of said tray slopes downward toward said opening to enhance drainage of liquid.

* * * * *